US006052843A

United States Patent [19]

Pirillo

[11] Patent Number: 6,052,843

[45] Date of Patent: Apr. 25, 2000

[54] FLOAT-RETAINING COVERING DEVICE

[76] Inventor: Sal Pirillo, 1311 Scimitar Ave., Elmont, N.Y. 11003

[21] Appl. No.: 09/075,907

[22] Filed: May 11, 1998

[51] Int. Cl.[7] ..... E04H 4/10

[52] U.S. Cl. ..... 4/498; 4/499; 4/503

[58] Field of Search ..... 4/498, 499, 503

[56] References Cited

U.S. PATENT DOCUMENTS 3,801,994 4/1974 Brown ..... 4/499

FOREIGN PATENT DOCUMENTS 2447436 9/1980 France ..... 4/499
2671125 7/1992 France ..... 4/498

*Primary Examiner*—Charles R. Eloshway

*Attorney, Agent, or Firm*—Michael I. Kroll

[57] ABSTRACT

A float retaining cover device 10 comprising a non-permeable cover sheet 12 supported by a floating member 14. The latter can be a free-floating retention method using grommets 20 attached to the central underside of the cover sheet 12 and on the float 14 with a cord 22 fastening the two together, or a system using straps and fasteners. An enclosed retaining pocket 16 can also be employed to maintain the float 14. When a permeable sheet is used to form the retaining pocket 16, there is a sealable recess 40 in the sheet of the pocket 16 to insert and remove the float 14. When the retaining pocket 16 is non-permeable, all edges are hermetically sealed to the bottom of the cover sheet 12 and the recess 24 is located on the cover sheet 12 in a central position in relation to the retaining pocket 16. The recess 24 has an elastomeric border 26 that allows the float 14 to pass through when there is excessive pressure pushing down on the cover sheet.

7 Claims, 8 Drawing Sheets

FLOAT-RETAINING COVERING DEVICE

BACKGROUND OF THE INVENTION

1. Field of the Invention

The present invention relates generally to covering devices and specifically to a swimming pool cover that retains a floating member in a central portion of the pool.

2. Description of the Prior Art

There are numerous swimming pool covers known in the art which provide for the installation of a pillow which is positioned in the center of the pool.

For example, U.S. Pat. No. 3,366,977 issued to Carl A. Koehler on Feb. 6, 1968 discloses a swimming pool cover for use while the pool is full. A floatable member is secured to the underside of a liquid impervious sheet material which itself is stretched over the pool and anchored at its periphery. The floatable member rests on the surface of the water and is of sufficient size to raise the central part of the cover to form an arch such that rain water, leaves, etc., do not accumulate on it.

U.S. Pat. No. 4,685,254 issued to Claude J. Terreri on Aug. 11, 1987 discloses a swimming pool cover support comprising a balloon for placement in its uninflated condition on the surface of the water of a swimming pool, an air hose having one end attached to the balloon and provided at its other end with a valve. The hose is of sufficient length that when the balloon is secured in a predetermined position, the valve can be located outside the pool, whereby the balloon can be inflated or later deflated.

U.S. Pat. No. 4,847,925 issued to Cliff R. Perry on Jul. 18, 1989 shows a cover for a pool, hot tub or the like wherein the pool structure has an upper perimeter portion defining a pool area where water is contained. The cover has a first upper flexible sheet member having a first central portion and a first perimeter portion and a second lower perimeter sheet member having a second central portion and a second perimeter portion. The first central portion of the first upper sheet member is separated from the second central portion of the second lower sheet by a support member. The support member has a sufficiently large vertical dimension to support the central portion of the first upper sheet member such that the first upper sheet member extends radially outwardly from the first central portion to the first perimeter portion at a moderate downward slope so that water and debris that fall on the cover move outwardly and downwardly of the first central portion of the first upper sheet member. The first perimeter portion of the first upper sheet member is attached substantially entirely around the second perimeter portion of the second lower sheet member and the first upper sheet member is spaced apart from the second lower sheet member by the support member thereby creating an insulating dead air space so as to provide heat insulation for water in the pool.

U.S. Pat. No. 5,144,704 issued to Charles Genzel on Sep. 8, 1992 shows a pool cover utilizing multiple, laterally displaced air compartments which are fixed in location with respect to each other, and are integral portions of the cover. The air compartments may be interleaved by having laterally overlapping portions in order to minimize sagging which may result if any air compartment were to have an air leak. The cover can include a removable exterior portion which is exposed, and an interior portion containing the air pockets which are in contact with the pool surface. This allows for easy removal of the top portion of the cover for cleaning and for examining individual air compartments.

As will be seen, the simplicity and effectiveness of my invention is not rivaled in the prior art. None of the above inventions and patents, taken either singly or in combination, is seen to describe the instant invention as claimed.

SUMMARY OF THE PRESENT INVENTION

It is a primary object of the present invention to provide a cover device which will overcome the shortcomings of prior art devices.

Another object of the present invention is to provide a cover device which will retain a floating member in a central portion of the pool.

Still another object of the present invention is to provide a cover device which will have a retaining pocket to keep a floating member in place during and after installation.

Another object of the present invention is to provide swimming pool cover with an elastomeric aperture above a centrally located retaining pocket.

The compartment will house floating member until such time as sufficient pressure is applied which will cause the elastomeric aperture to act as an egress for floating member.

A still further object of the present invention is to provide the swimming pool cover with a floatingt member located in the center and forming an integral part of the swimming pool cover.

Yet another object of the present invention is to provide means for inflating and deflating the floating member through a valve located on the periphery of the swimming pool cover and connected to the floating member by a conduit integrated into the cover leading to and forming a component part of the floating member.

Another object of the present invention is to provide a swimming pool cover that can be easily installed, maintained, and removed by a single individual.

Another object of the present invention is to provide a swimming pool cover that can be deflated, folded and stored into as small a bundle as the material of swimming pool cover will allow.

Additional objects of the present invention will appear as the description proceeds.

The novel features which are considered characteristic for the invention are set forth in the appended claims. The invention itself, however, both as to its construction and its method of operation, together with additional objects and advantages thereof, will best be understood in connection with the accompanying drawings. Attention is called to the fact, however, that the drawings are illustrative only, and that changes may be made in the specific construction illustrated and described within the scope of the appended claims.

The foregoing and other objects, advantages and characterizing features will become apparent from the following description of certain illustrative embodiments of the invention.

The novel features which are considered characteristic for the invention are set forth in the appended claims. The invention itself, however, both as to its construction and its method of operation, together with additional objects and advantages thereof, will best be understood in connection with the accompanying drawings. Attention is called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

FIG. 4 is a top plan view of the present invention. The retaining means shown in outline is a watertight pocket with a centrally located elastomeric recess which will expand under pressure, allowing the inflatable pillow to pass through.

Figure 7:
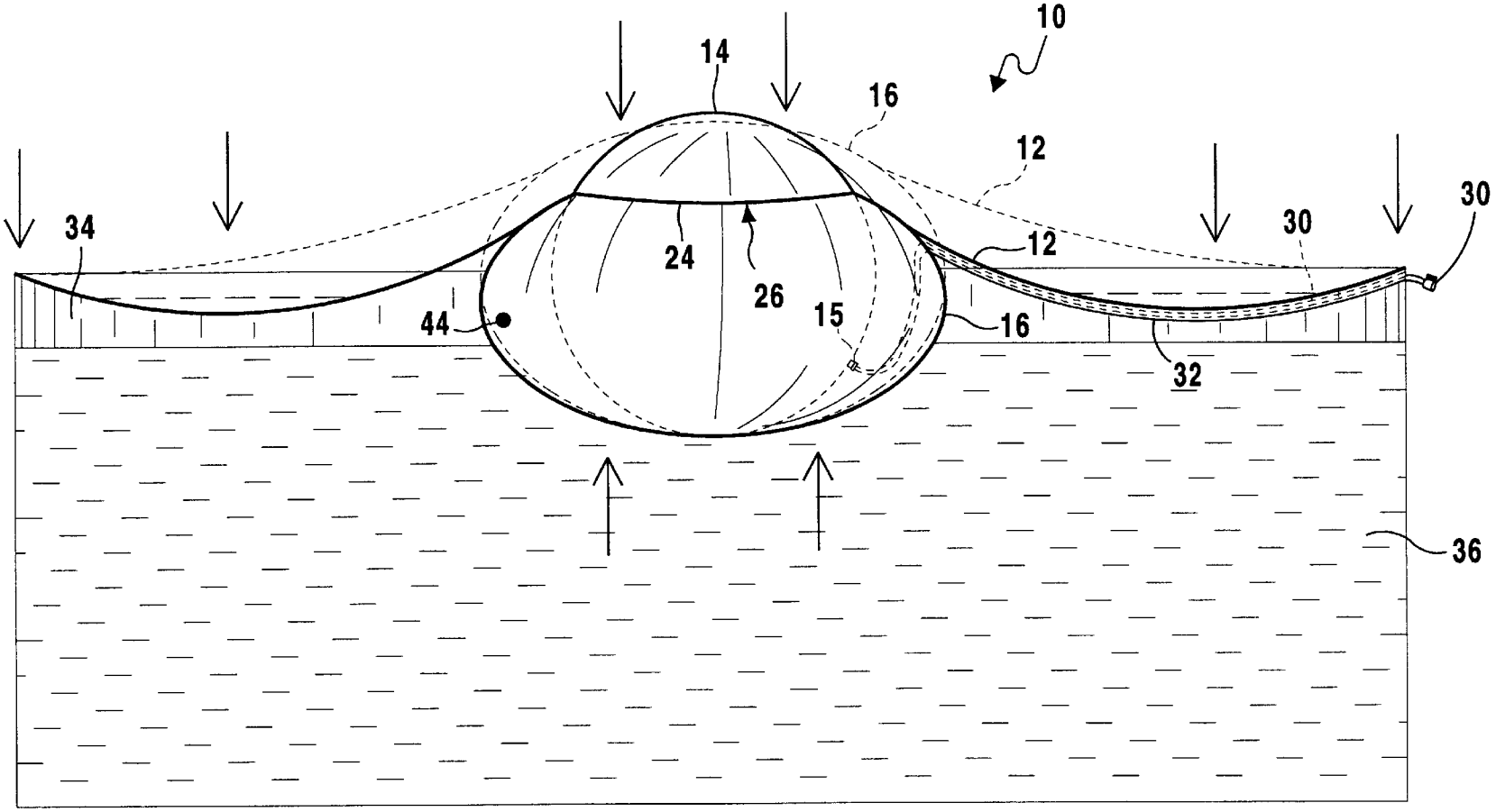

FIG. 7 is a partial sectional view of the present invention in place over a typical pool which has a considerable amount of water now contained on the swimming pool cover between the walls of the swimming pool and the airtight member. The invention relieves the stress placed on the cover and the periphery of the swimming pool by allowing the floating means to extend through the elastomeric aperture while maintaining position at the center of the swimming pool.

Figure 8:
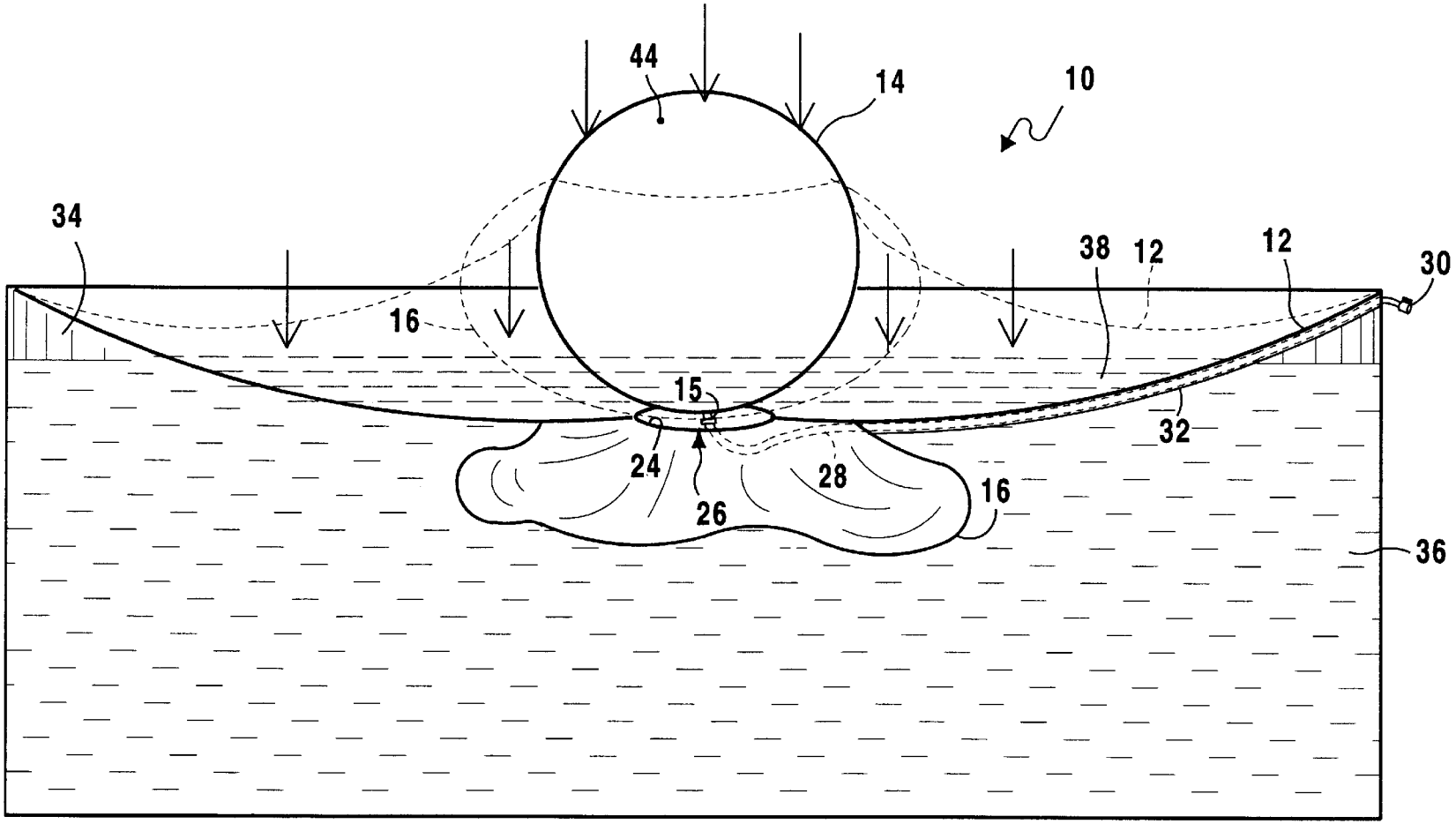

FIG. 8 is a partial sectional view of the present invention in place over a typical pool where water, ice, and or snow has accumulated. The elastomeric aperture has fully opened and allowed the floating means to pass through. The floating means is secured to the cover device by the connection to the remote inflation tube.

DETAILED DESCRIPTION OF THE PREFERRED EMBODIMENTS

Turning now descriptively to the drawings, in which similar reference characters denote similar elements throughout the several views, the Figures illustrate the composition and structure of the present invention. With regard to the reference numerals used, the following numbering is used throughout the various drawing figures.

10 covering device
12 cover sheet
14 floating means
15 check valve
16 retaining pocket
18 cover securing grommets
20 retaining grommets
22 cord
24 recess of 12
26 elastomeric border of 24
28 remote inflation tube
30 remote valve
32 tube channel
34 pool wall
36 pool water
38 rain water
40 recess of 16
42 hook and loop fastener
44 non-permeable material
46 permeable material The present invention relates to a float retaining device for covering a swimming pool. The device consists of two necessary components—a non-permeable cover sheet 12 able to cover the entire pool, and means for retaining a float 14 in a central region of the pool in between th cover device 10 and the pool water 36.

Figure 1:
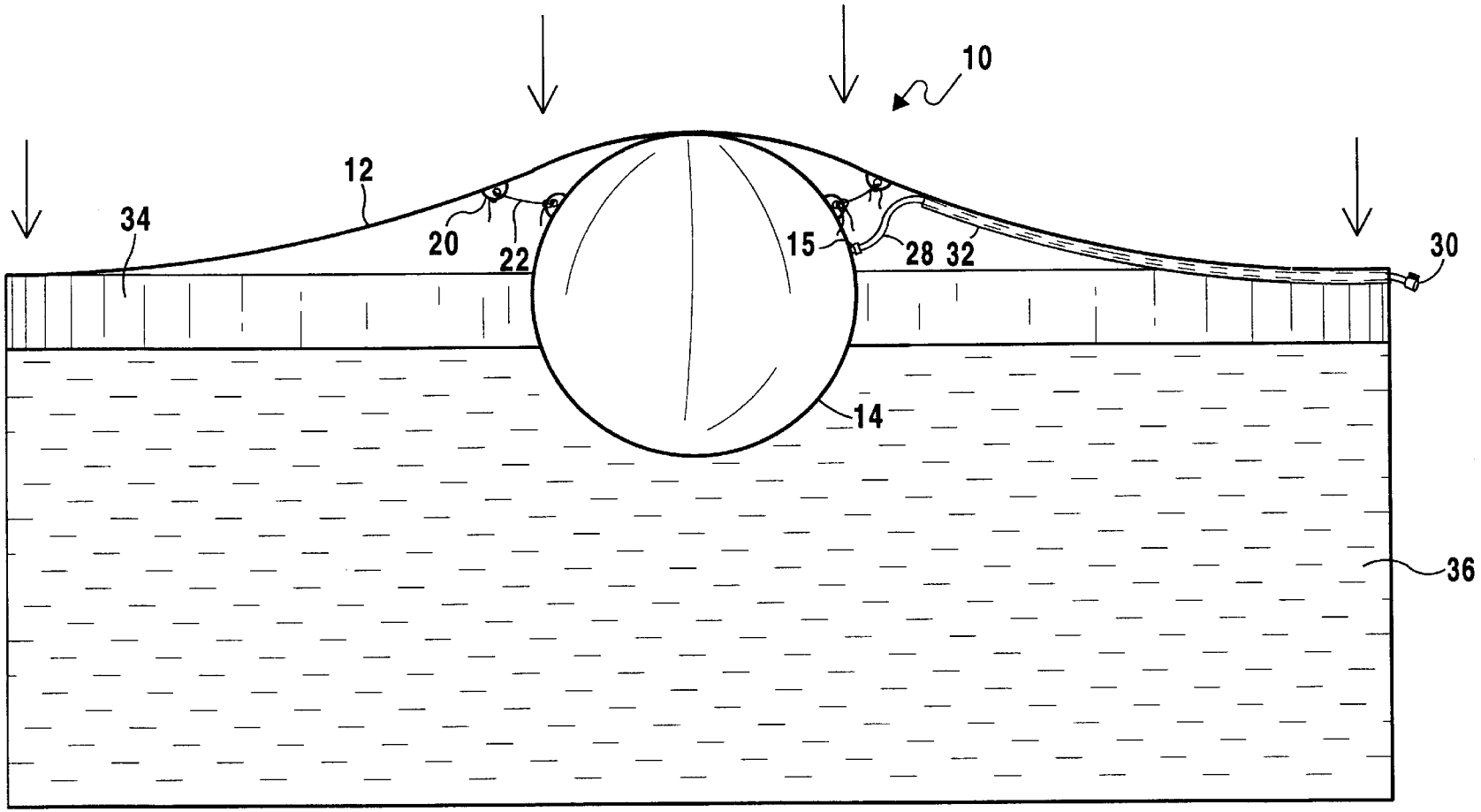
FIG. 1 is a partial sectional view of the present invention in place over a typical pool. The retaining means shown is a system of grommets and cords.

The two preferred methods of retaining the float 14 in the present invention are free-floating retention means and enclosed retaining pockets 16. A free-floating retention means as shown in FIG. 1 includes a cover sheet 12 and a float 14, each with anchoring mechanisms, in this case retaining grommets 20, and one or more cords 22 to secure the float directly to the cover sheet 12. Another free-floating retention means includes straps emanating from the underside of the cover sheet 12 and/or the float 14 using fasteners selected from but not limited to: snaps, hook and loop type fasteners, buckles, latches, knots and clips. The preferred number of straps and their respective fasteners used to retain the float 14 is four.

FIG. 1 shows an inflatable float 14 with a check valve 15 as an air inlet connected to a remote inflation tube 28 running through a tube channel 32 integrated within the cover sheet 12. The tube channel 32 begins in a centrally located underside of the cover sheet 12 and extends to the perimeter. The interior end of the inflation tube 28 attaches to the check valve 15 using an airtight releasable connection such as a threaded or quick-connect type. The exterior end of the inflation tube 28 extends beyond the perimeter of the cover sheet 12 and has a remote valve 30 adapted to receive a means of inflation such as a pump or compressor. The remote valve 30 also is capable of forming an airlock to prevent air from escaping from the inflatable float 14. This allows the uninflated float 14 to be retained by the cover sheet 12 prior to installation. The user can inflate the float 14 from a remote spot outside the pool area once the cover device 10 is installed and secured.

Figure 2:
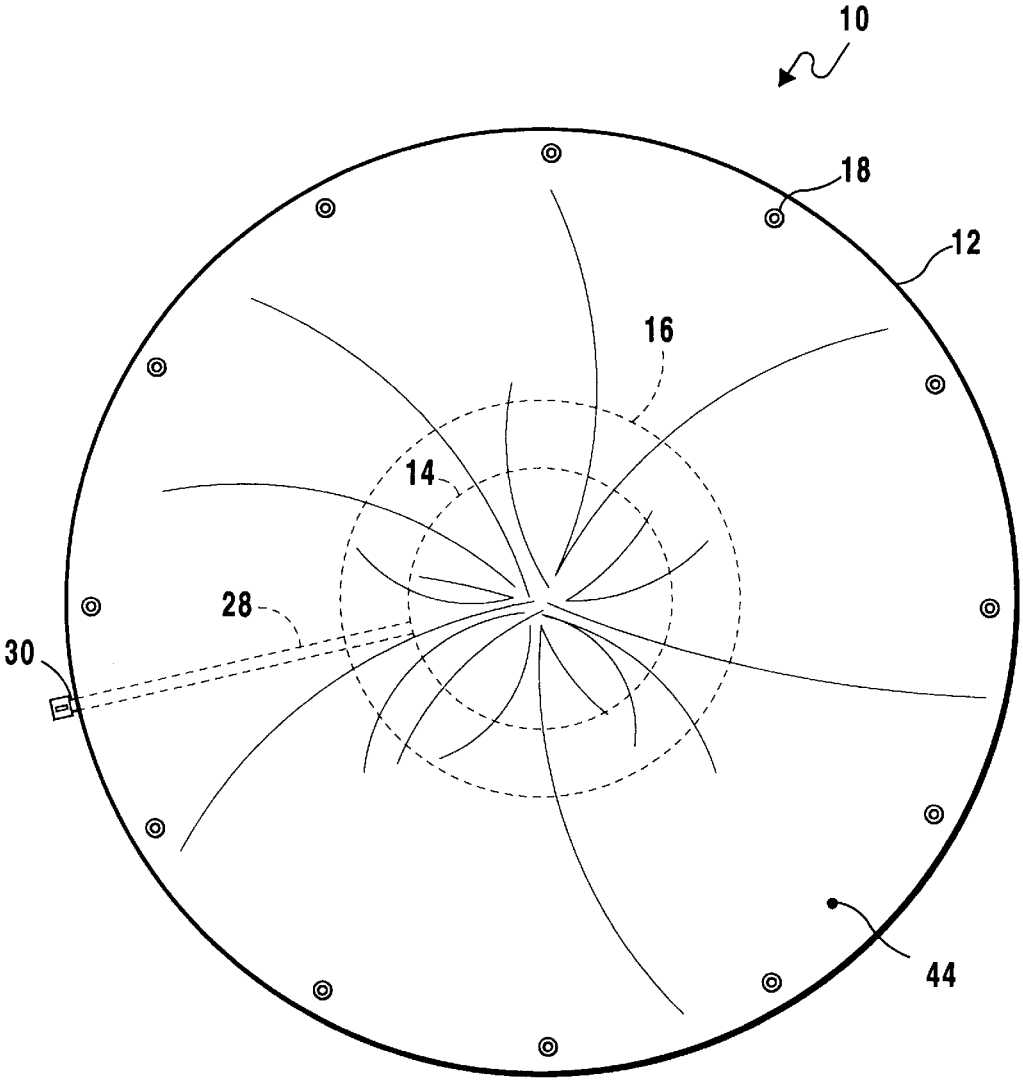
FIG. 2 is a top plan view of the present invention wherein the retaining means is a sheet forming a retaining pocket below the cover sheet as shown in FIG. 3.
Figure 3:
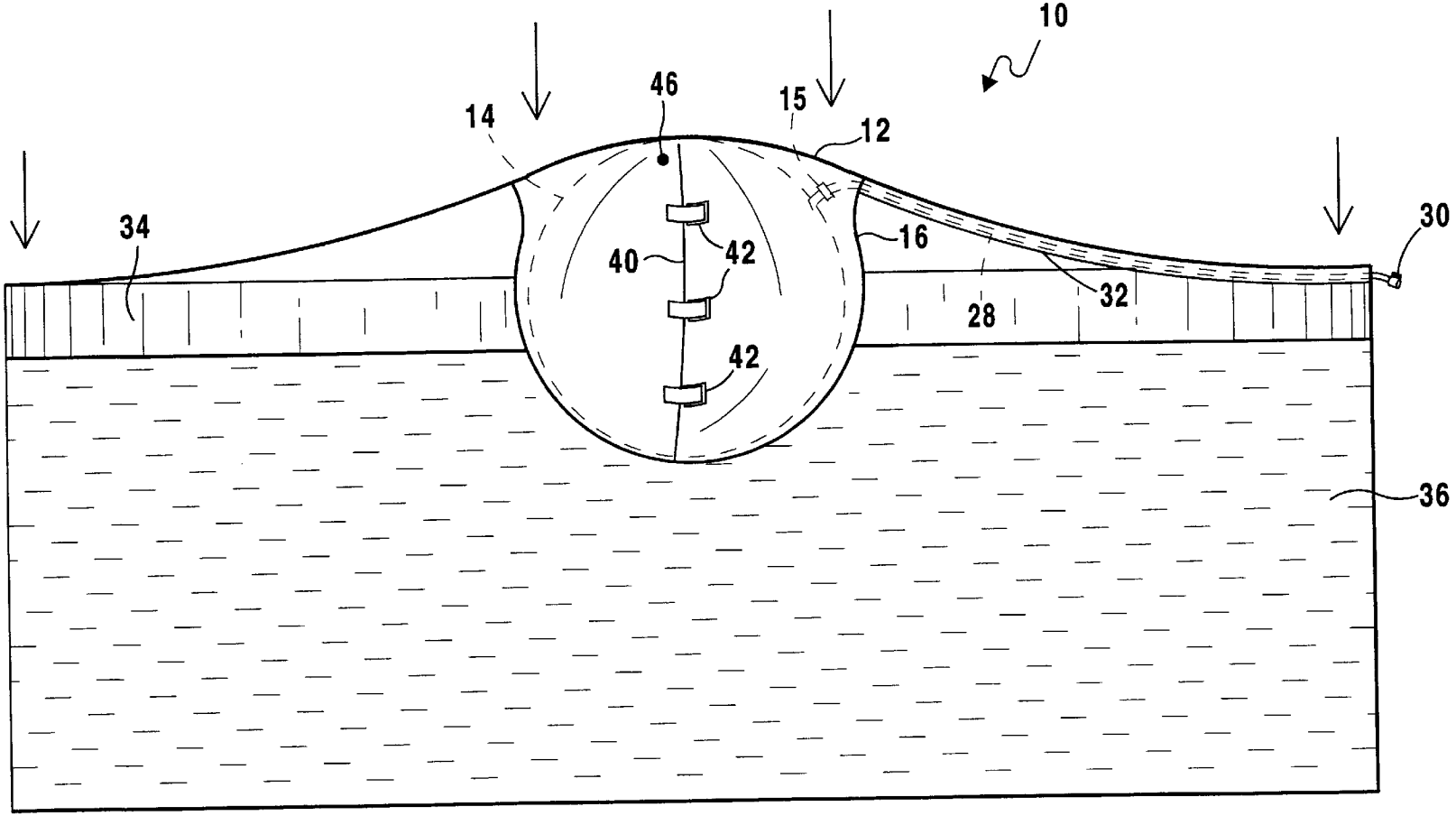
FIG. 3 is a partial sectional view of the present invention in place over a typical pool. The retaining means shown is a mesh pocket that is accessed by an opening which is secured by hook and loop type fasteners.
Figure 4:
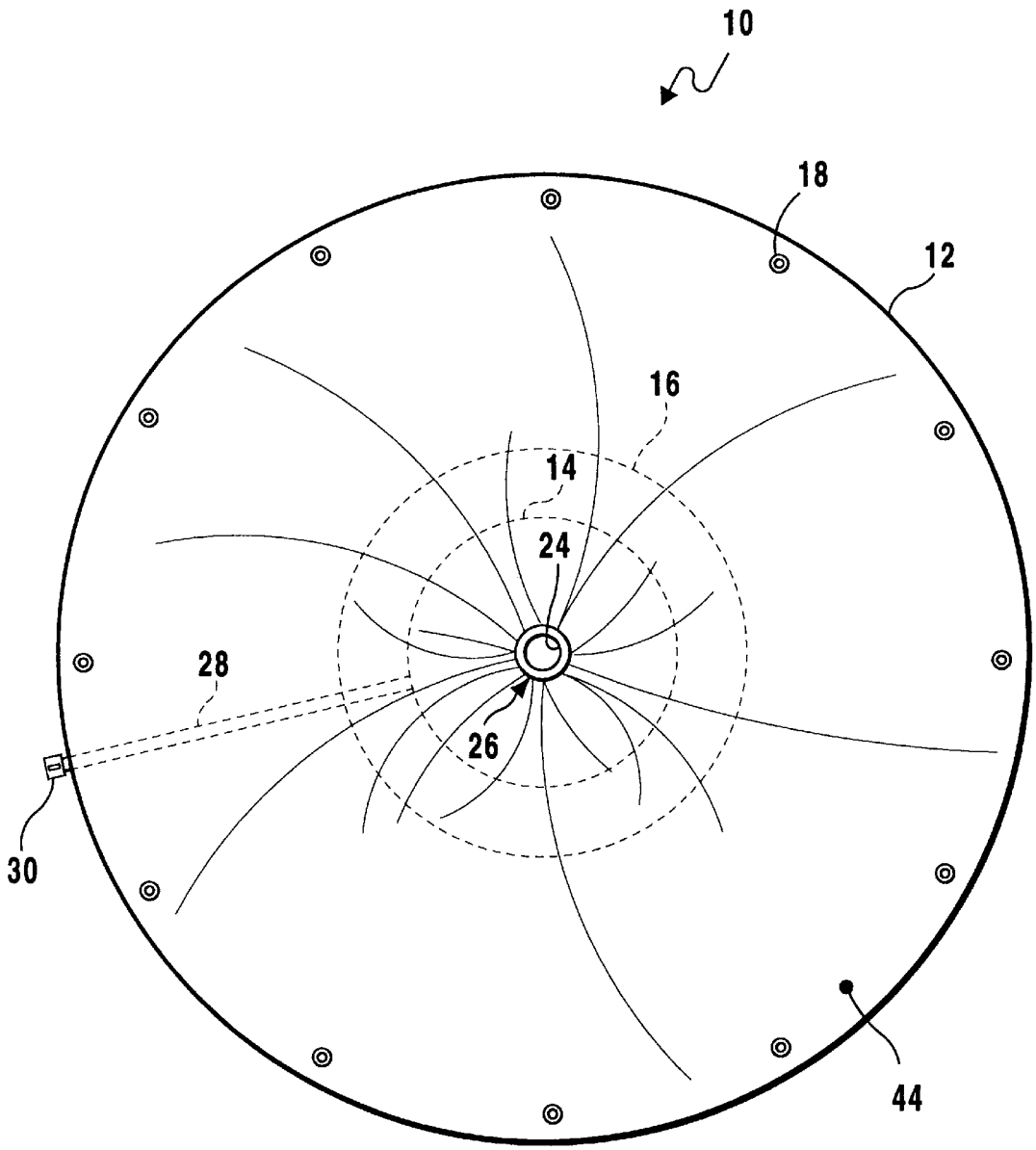
Figure 5:
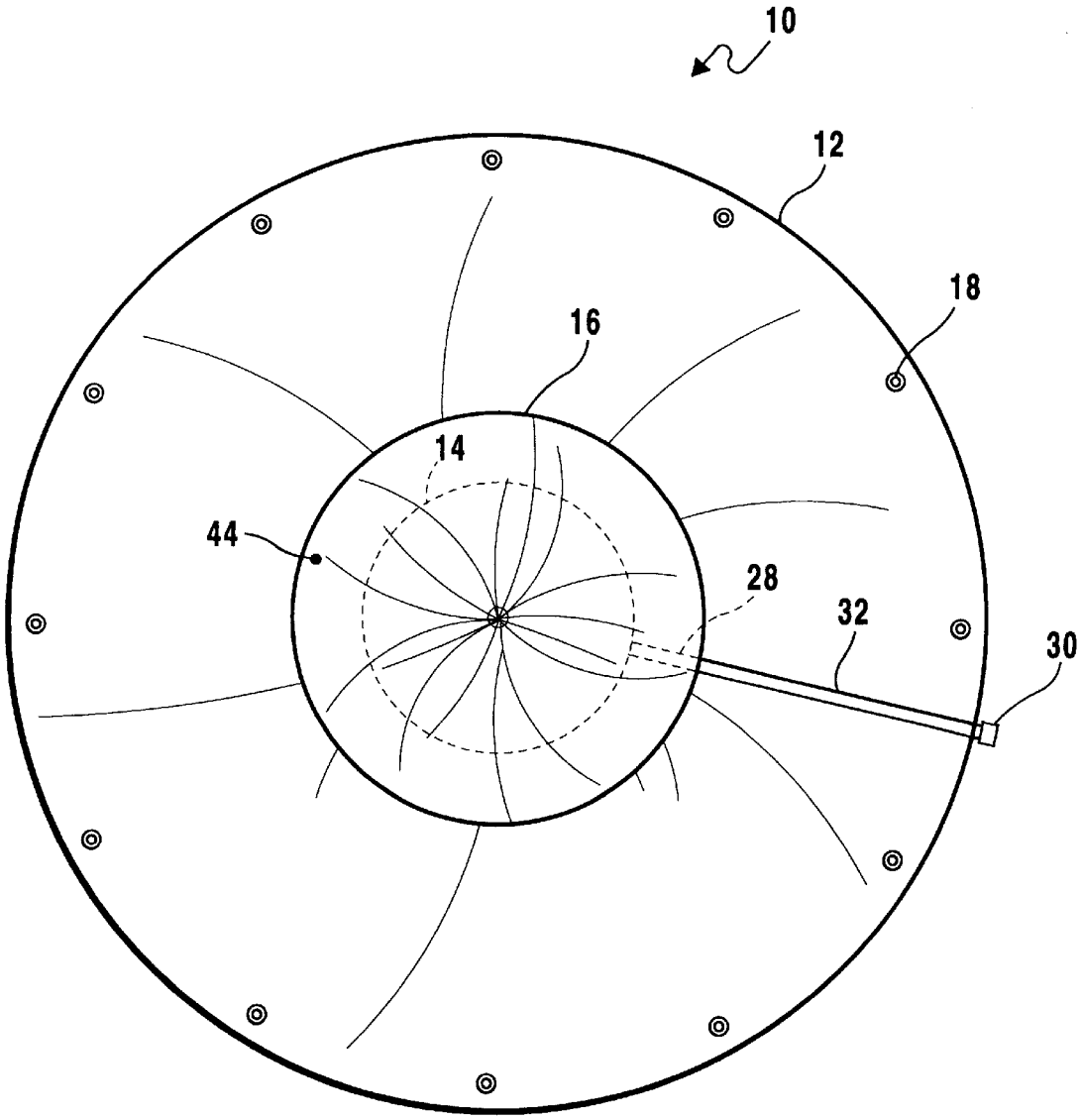
FIG. 5 is a bottom plan view of the present invention as shown in FIG. 4.
Figure 6:
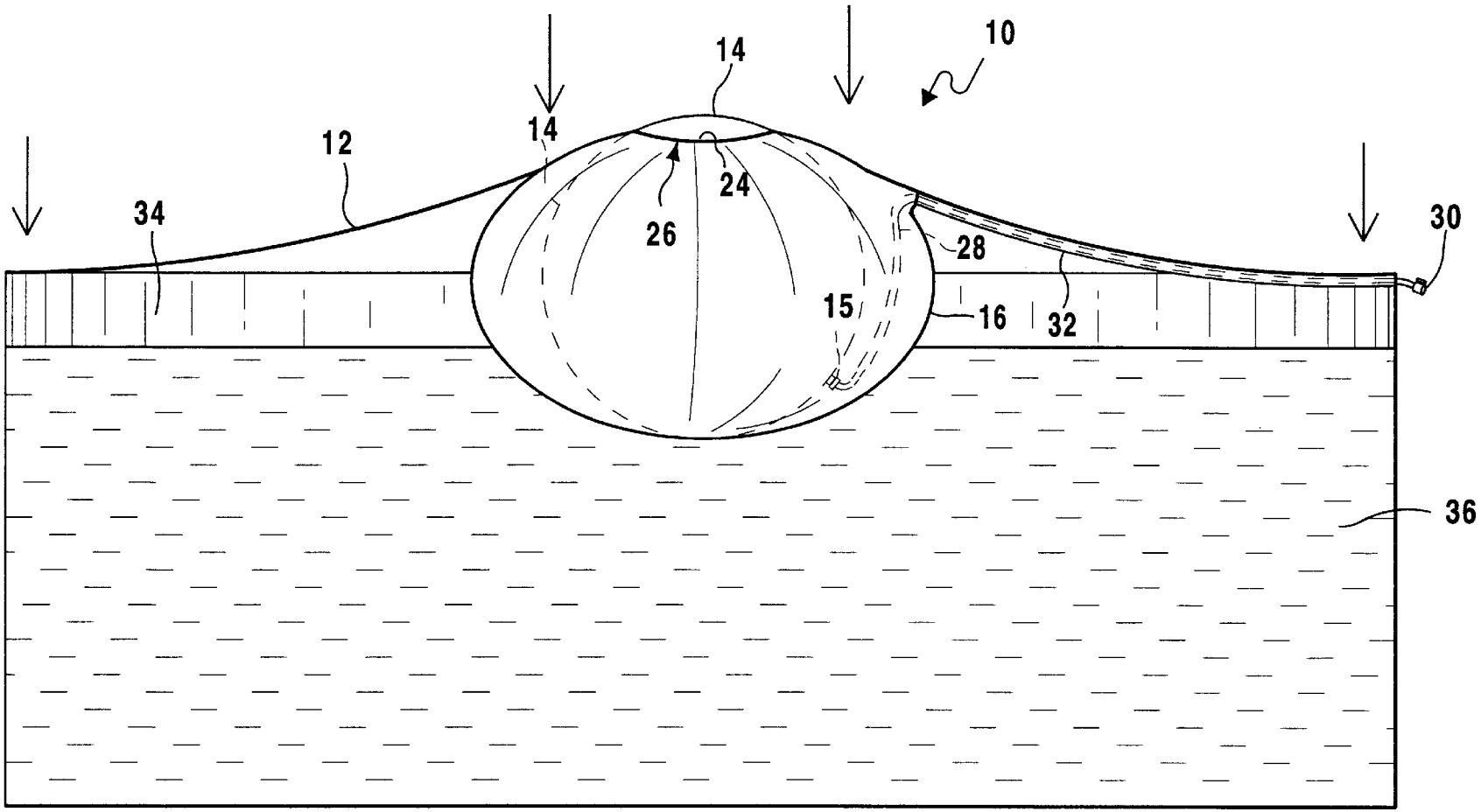
FIG. 6 is a partial sectional view of the present invention in place as shown in FIGS. 4 and 5

FIGS. 2 through 8 illustrate float retaining cover devices 10 with enclosed retaining pockets 16. FIGS. 2 and 3 show a cover device 10 with a solid cover sheet 12 and a retaining pocket 16 fabricated of a permeable material, preferably a netting or a mesh. The retaining pocket 16 has a recess 40 for inserting and removing the float 14. The recess has a means for securing the inserted float 14, FIG. 3 shows several hook and loop fasteners 42 although snaps, zippers, latches and the like could also be used.

FIGS. 4 through 8 illustrate a cover device 10 with a cover sheet 12 with a centrally located cover recess 24. The cover recess 24 has an elastomeric border 26 that allows it to stretch wide enough for the fully inflated float 14 to pass through. The retaining pocket 16 is made of a non-permeable material 44 with sealed seams to form a watertight compartment. When the cover device 10 is installed and secured with a fully inflated float 14 inside the retaining pocket 16 and no water or debris is on top of the cover sheet 12, the elastomeric border 26 of the cover recess 24 sits atop the float 14 in a relatively closed state. When excessive pressure is applied to the top of the cover sheet 12 due to rain, ice, snow, debris, and the like, it pushes the cover sheet down thereby causing the elastomeric border 26 to expand around the float 14 thereby relieving excess pressure and consequent damage to said cover sheet. If the pressure is great enough, the float will be forced completely through the expanded recess so that the cover will remain undamaged.

The advantages of the float 14 passing through are two-fold. The first is that the cover device 10 effectively lowers itself, relieving stress on the cover sheet 12 and the peripheral pool structure. Secondly, the float 14 passing through the recess 24 gives a visual indication that the pool cover needs to be pumped or cleaned.

When the pressure exerted on the top of the cover sheet 12 becomes too great, the recess 24 will eject the float 14 entirely, showing that the cover 10 is in dire need of maintenance. The connection with the remote inflation tube 28 can act as a retaining clip to prevent the float from blowing away.

The cover sheet 12 preferably has securing grommets 18 placed around the perimeter to provide a means for securing the cover device 10 to the swimming pool. The cover extends beyond the pool edge and hangs down along pool sidewall. A cord is laced through the grommets until the first end meets with a second end which are then fastened to and tightened with either a winch or a turnbuckle.

It will be under stood that each of the elements described above, or two or more together, may also find a useful application in other types of applications differing from the type described above. These include, for example, agricultural, industrial and commercial applications in addition to the residential use discussed herein.

While the invention has been illustrated and described as embodied in a swimming pool cover, it is not intended to be limited to the details shown, since it will be understood that various omissions, modifications, substitutions and changes in the forms and details of the formulation illustrated and in its operation can be made by those skilled in the art without departing in any way from the spirit and scope of the present invention.

Without further analysis, the foregoing will so fully reveal the gist of the present invention that others can, by applying the current knowledge, readily adapt it for various applications without omitting features that, from the standpoint of prior art, fairly constitute essential characteristics of this invention.

What is claimed as new and desired to be protected by Letters Patent is set forth in the appended claims:

1. A device for covering a structure for retaining a liquid therein, said covering device comprising:

a) a non-permeable cover sheet having a top and an underside, removably secured about a periphery of said structure;

b) means comprising an inflated ball shaped member floating on the liquid within the structure below and supporting said underside of said cover sheet; and c) means for retaining said floating means in its position between the liquid and said underside of said cover sheet comprising a plurality of grommets along a top surface of said inflated ball shaped member, a plurality of grommets mounted on the underside of said cover adjacent the grommets on said inflated ball shaped member, and means tying together adjacent grommets on said cover and ball member to secure said ball shaped member to said cover.

2. A covering device as defined in claim 1, wherein said tying means comprises at least one cord.

3. A covering device as defined in claim 1, having means to introduce gas to an interior region of said ball shaped member.

4. A covering device as defined in claim 3, wherein said means to introduce gas comprises a check valve.

5. A covering device as defined in claim 4, wherein said means to introduce gas further includes a remote inflation tube having a first end originating under said cover sheet and within said ball shaped member; a central portion running within a tube channel integrated within said cover sheet; and a second end extending towards the periphery of said cover sheet and exiting beyond said cover sheet.

6. A covering device as claimed in claim 5, wherein said first end of said tube is adapted to releasably attach to said check valve with an airtight seal.

7. A covering device as defined in claim 6, wherein said second end of said remote inflation tube has a means for accepting a gas propulsion device and a means of hermetically sealing said tube after introducing gas.

* * * * *